United States Patent [19]

Katchka

[11] 4,255,118

[45] Mar. 10, 1981

[54] ELECTRIC IGNITION SYSTEM

[75] Inventor: Jay R. Katchka, Cypress, Calif.

[73] Assignee: Robertshaw Controls Company, Richmond, Va.

[21] Appl. No.: 898,175

[22] Filed: Apr. 20, 1978

[51] Int. Cl.[3] ..... F23Q 9/08

[52] U.S. Cl. ..... 431/46; 431/53

[58] Field of Search ..... 431/46, 53, 54, 77

[56] References Cited

U.S. PATENT DOCUMENTS

| | | | |
|---|---|---|---|
| 2,833,894 | 5/1958 | Weber et al. | 337/323 |
| 3,108,630 | 10/1963 | Forniti | 431/54 |
| 3,501,253 | 3/1970 | Wade | 431/43 |
| 4,106,889 | 8/1978 | Katchka | 431/53 |
| 4,188,180 | 2/1980 | Hamelink | 431/46 |

*Primary Examiner*—Carroll B. Dority, Jr.

*Attorney, Agent, or Firm*—Fulwider, Patton, Rieber, Lee & Utecht

[57] ABSTRACT

There is disclosed a control system for ignition and operation of a combustible gas burner for heating appliances. The control system is intended for use with fuel burners having interrupted or discontinuous pilot burner operation. The control system utilizes the characteristic of a thermomechanical flame sensor such as a diastat, thermocouple, or bi-metallic strip to control the cycling of the system in the event of extinguishing of the burner flame by momentary gas or electrical interruption or air drafts.

3 Claims, 4 Drawing Figures

FIGURE 2
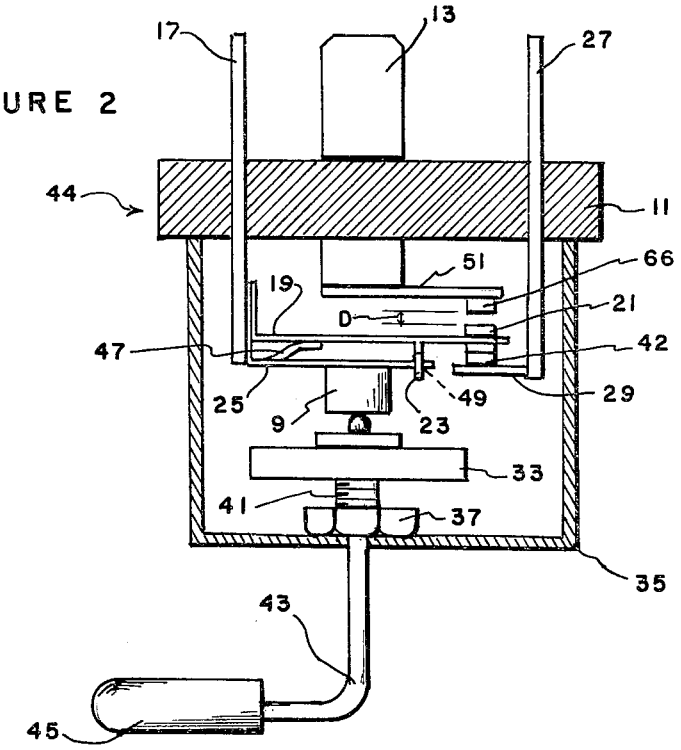
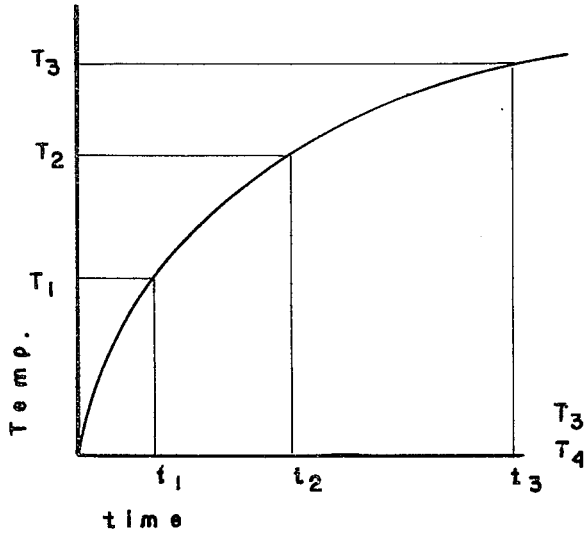
FIGURE 3
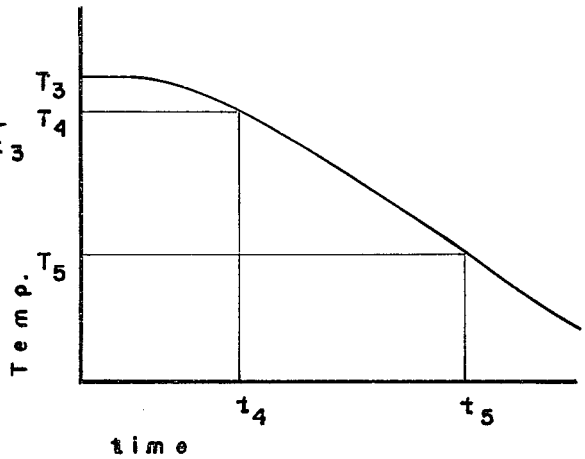
FIGURE 4

ELECTRIC IGNITION SYSTEM

BACKGROUND OF THE INVENTION

1. Field of the Invention:

This invention relates to a burner control system and in particular to a control system for the ignition and operation of an interrupted pilot burner system.

2. Brief Statement of the Prior Art:

The commonly used ignition and burner control system employs a pilot burner and main burner which are furnished fuel through controlled valves. The pilot burner is on continuously and a flame sensor is positioned in the pilot burner flame and operatively connected by the gas valve to the burner to ensure that gas is not supplied to the main and pilot burners unless a flame is present at the pilot burner. A recent U.S. Pat. No. 3,501,253, discloses a slightly more sophisticated electrical control system in which a safety switch is provided in the circuit and this safety switch responds to the current supply to the pilot burner valve so that the safety switch is in the off position unless the valve supplying gas to the pilot burner is open.

The necessity for gas conservation has prompted the design of ignition facilities for discontinuous or interrupted pilot burner systems. The various fail safe requirements of this system have triggered the development of numerous control systems which are quite complex. The use of complex systems with many distinct components, however, generates unreliability because any of the numerous components is subject to failure or maloperation.

BRIEF STATEMENT OF THE INVENTION

This invention comprises a control system for the ignition and operation of a combustible gas burner and pilot burner assembly having interrupted or discontinuous pilot burner operation. The control system utilizes the inherent switching time delay of a thermomechanical flame sensor to achieve a delay in recycling of the burner system following extinguishment of the flame by drafts or momentary gas or electrical interruptions. The control system employs a pair of control valves main and redundant, serially connected in the main burner gas supply and a pilot burner gas supply connected between the valves, bypassing the main burner gas supply control valve. The igniter is in a first control circuit which includes the thermostat and the cold position contacts of the flame sensor. The redundant control valve is in a second control circuit which also includes the cold position contacts of the flame sensor and the thermostat. The main control valve is in a third control circuit which includes the hot position contacts of the flame sensor.

The flame sensor is a thermomechanical device such as a thermocouple or diastat which responds to the extinguishment of a flame opening of its hot position contacts within a period of 20 to about 40 seconds followed by a switching time delay of 5 to about 15 seconds before closing of the cold position contacts. This time delay is utilized by the control system to ensure purging of any unignited combustible gas from the appliance before the igniter circuit is enabled and the device is recycled, since the igniter is only on when the cold contacts of the flame sensor are closed.

BRIEF DESCRIPTION OF THE FIGURES

The invention will be described with reference to the FIGURES of which

FIG. 2 illustrates a flame switch for the invention; and

FIGS. 3 and 4 depict the operating characteristics of the flame switch.

DESCRIPTION OF THE PREFERRED EMBODIMENTS

Figure 1:
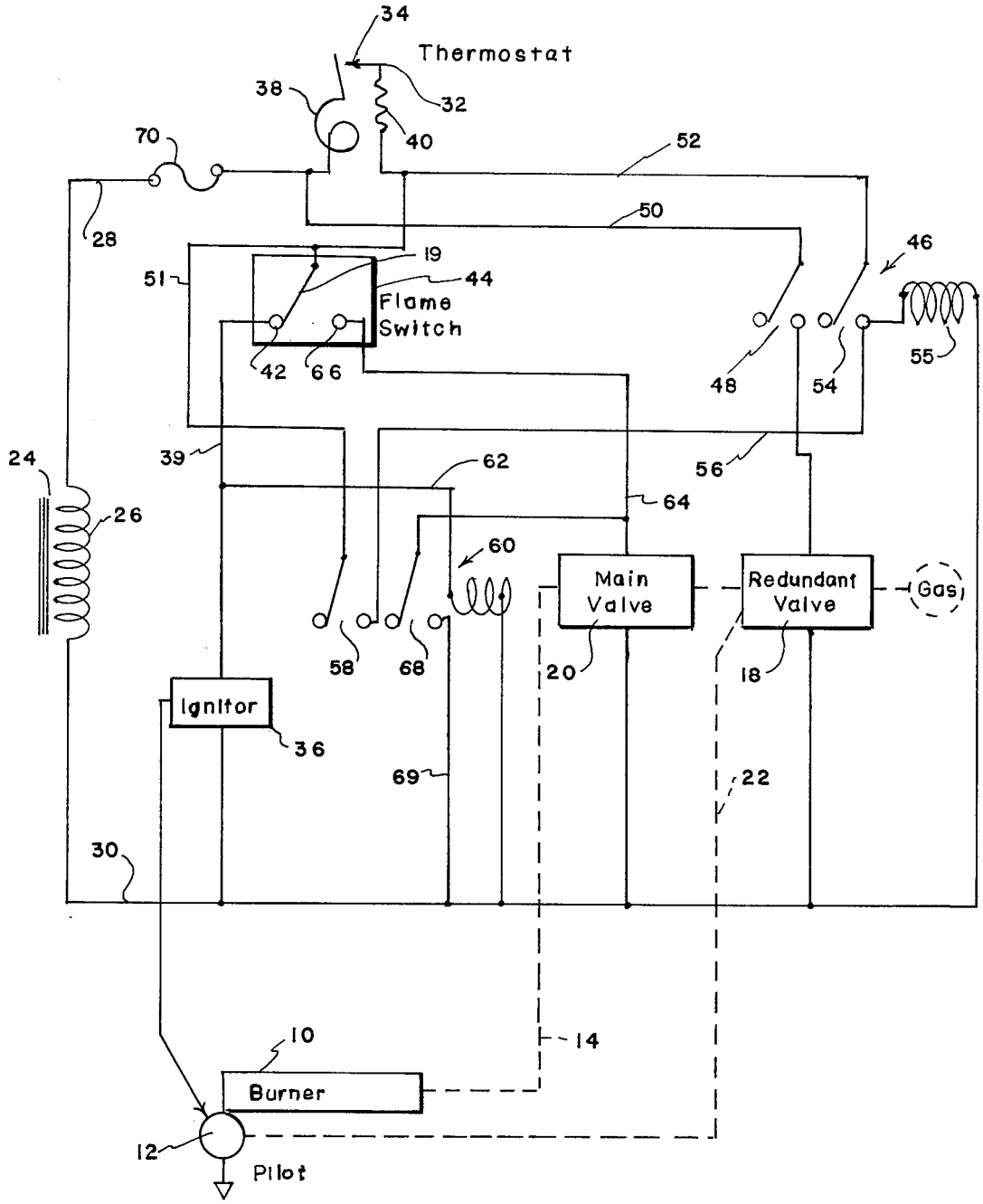
FIG. 1 is a schematic diagram of the control and burner system.

Referring now to FIG. 1, there is illustrated the control and burner systems of the invention. The appliance is provided with a main gas burner 10, a pilot burner 12, and gas supply means including a main burner gas supply conduit 14, which is connected through redundant control valve 18 and main control valve 20. A pilot burner gas supply conduit 22 extends from downstream of the redundant control valve 18, bypassing the second or main control valve 20.

The control system is provided with electrical power through transformer 24 having its secondary windings 26 connected to the electrical supply busses 28 and 30 of the control circuit. The heating demand means 32 can comprise a conventional thermostat having switch contacts 34 and a bi-metellic switch lever 38 responsive to sensed temperature. As conventional in such thermostats, an anticipator resistor 40 can be provided to reduce the tendency of the system to overshoot the control temperature.

The ignitor 36 can be any conventional ignition device such as a sparking electrode, glow plug and the like, is in a first control circuit that includes conductor 39 which is connected to the cold position contact 42 of the flame switch 44. The flame switch 44 includes a thermomechanical flame sensor which is mounted in proximity to the pilot burner to be sensitive to its flame. A suitable flame sensor for this purpose is a diastat, a bulb and enclosed capillary tube filled with an expandible liquid, such as mercury and the like, or a thermocouple. These devices respond to the extinguishment of a flame by cooling, within a period of 20–40 seconds, typically 30 seconds to separate the switch lever 45 from the hot contact followed by a cooling period of from 5 to about 15 seconds before closing of the switch contact on the cold contact.

The second control circuit includes relay 46 having a normally open pair of contacts 48 which are connected in circuit by conductor 50 with the power supply line 28, bypassing the thermostat 32 and flame switch 44. Conductor 52 is in circuit with the thermostat and normally open pair of contacts 54. Conductor 50, which bypasses the thermostat 32 is in circuit to the holding coils of solenoid valve 18, the redundant control valve of the system.

The activating circuit for relay 46 comprises conductor 56 which is in circuit through normally open contacts 58 of relay 60 with the thermostat 32 by conductor 51 which bypasses the flame switch 44. The activating circuit for relay 60 comprises conductor 62 which is in circuit to the cold contact 42 of flame switch 44.

The third control circuit of the invention includes the holding coil of the main control valve 20 and conductor 64 which connects in circuit thereto the hot position contact 66 of flame switch 44.

Protective circuit means are also provided to prevent the unintentional and improper installation of the control system by preventing the shorting of the hot and cold contacts of flame switch 44. This protective circuit comprises a grounding lead 69 between buss 30 and the normally open, second pair of contacts 68 of relay 60 and conductor 64 which connects in circuit thereto the hot position contact 66 of the flame switch 44. A fuse 70 is placed in the electrical supply, e.g., in buss 28 so that in the event the hot and cold contacts of flame switch 44 are shorted, the supply voltage is applied through conductor 64 and contact 68 and conductor 69 to buss 30, destroying fuse 70.

Referring now to FIG. 2, the flame switch 44 will be described. The preferred switch is a diastat which, typically, has the illustrated structure. The switch has a housing formed of a ceramic base 11 and a cover 35. The ceramic base 11 supports a first quick connect terminal 13 which has an arm 51 to support fixed contact 66.

A second quick connect terminal 17 supports a contact spring 19 with contact 21 and a bracket 23 having a slot 49. Terminal 17 also supports an operating spring 25 with an insulator pad 9. The end of spring 25 is received within slot 49 of bracket 23. Springs 25 and 19 are resiliently interconnected by leaf spring 47 which projects from spring 25 and biases against spring 19.

A third quick connect terminal 27 supports a spring arm 29 with a contact 42. A calibrating screw (not shown) permits fixed adjustability of the distance D between the fixed contact 66 and moving contact 21. A diastat 33 is attached to cover 35 with locknut 37 on threaded shaft 41. A capillary tube 43 connects the diastat with a sensing bulb 45. The diastat is filled with a thermally expansible fluid such as mercury. In operation, the diastat bulb is immersed in flame and the diastat expands to bear against pad 9 of the switch. Spring 25 is biased against the diastat and spring 19 is biased to close against contact 42. Spring 25 is biased to close contacts 21 and 42 and when the bulb is cool, contacts 21 and 42 are closed. When the bulb is heated, contacts 21 and 66 are closed. The timing of the switching is fixedly adjustable by variation of distance D.

The operating characteristics of the flame switch are shown in FIGS. 3 and 4 which depict, respectively, heating and cooling curves for the mercury filled bulb 45 and capillary tube 43. When ignition occurs and the bulb 45 is heated, it reaches temperature $T_1$ at time $t_1$. At this temperature, the cold position contacts 21 and 42 of flame switch 44 open. The bulb 45 continues to heat and when it reaches temperature $T_2$ at time $t_2$, the hot contacts 21 and 66 close. Further heating to a stabilization temperature $T_3$ occurs and the resilient switch arm provides an override for further heating of bulb 45. When the flame is extinguished, the bulb cools from temperature $T_3$. At temperature $T_4$, (FIG. 4) contacts 21 and 66 open. After a time interval $t_4$ to $t_5$, the bulb cools sufficiently to temperature $T_5$ to permit contacts 21 and 42 to close.

A thermocouple flame sensor has similar operating characteristics in that its voltage declines as the thermocouple cools following flame extinguishment. Switch actuation voltages can be similarly selected to provide a time interval ($t_5$–$t_4$) between breaking of the hot contact and making of the cold contact of the flame switch for use in the invention.

In operation, the control system senses a heating demand by the closure of the switch contacts 34 of thermostat 32, supplying electrical potential through the cold contact 42 of flame switch 44, to the igniter 36. Simultaneously, the potential is applied through conductor 62 to the coil of relay 60, closing the normally open switch contacts 58 of the relay and applying the electrical potential to coil 55 of relay 46 via conductor 56. The relay 46 closes relay contacts 48 and 54 and supplies the electrical potential to the solenoid of the redundant control valve 18, opening this valve and permitting gas to flow through the pilot burner supply conduit 22 to the pilot burner 12.

The gas is ignited at the pilot burner and the resultant flame heats the sensor of the flame switch, moving lever 45 from the cold contact 42. The gas is continued to be supplied to the pilot burner through valve 18 since the holding contacts 54 keep relay 46 energized to maintain the relay contacts 48 closed.

After a period from 20 to about 45 seconds, the switch lever 19 of the flame switch 44 closes on the hot contact 66, to supply electrical potential to the solenoid of the main control valve, opening this valve and supplying gas to the main burner 10 through the main burner gas supply conduit 14.

When the heating demand is satisfied, the thermostat contacts 34 open, discontinuing the supply of electrical potential to the circuit. This interruption opens the normally open contacts fo relays 46 and 60, interrupting the supply of electrical potential to the control valves 18 and 20, permitting these normally closed valves to close and extinguish the main and pilot burner flames.

Within a period of from 20 to about 40 seconds, the flame sensor cools sufficiently to move switch lever 19 from hot contact 66. Continued cooling of the flame sensor for an additional period of from 5 to about 15 seconds moves switch lever 19 sufficiently to close contact with the cold position contact 42, enabling the control system for recycling.

In the event that an interruption of the electrical supply occurs momentarily during a heating operation, e.g., by twiddling of the thermostat or by a momentary electrical interruption, the control system responds by closing the control valves 18 and 20 and extinguishing the main and pilot burner flames. If the electrical potential is established while the hot contacts 66 are closed, the electrical potential is reestablished and the main control valve 20 will open. The redundant control valve 18, however, will remain closed since it can only be opened by completion of its activation circuit through the cold position contact 42 of the flame switch 44. Accordingly, momentary electrical interruption requires cooling of the flame sensor and recycling of the control circuits.

In the event that the main and pilot burners are extinguished by a sudden draft or momentary gas interruption, the control system responds within 20 to about 40 seconds by opening of the flame switch contacts to the hot position contact 66. This closes the main control valve 20 and interrupts the supply of gas to the main burner. The igniter 36, however, is not activated until the switch lever 19 of the flame sensor 44 reaches the cold position contact 42. As previously mentioned, this requires an additional time period of from 5 to about 15 seconds and is adequate to ensure that any unignited gas supplied through the main burner 10 has been vented from the appliance. When the switch lever 19 reaches cold position contact 42, the control system is enabled for recycling and igniter 36 is activated to ignite the gas issuing from the pilot burner.

The control system of this invention provides a very simple and positive acting control for a pilot and gas burner for interrupted service. The invention utilizes the inherent time delay in switching of a conventional thermomechanical flame sensor to provide a time delay in recycling of the control system, thereby ensuring that any unignited gas which may be discharged into the appliance by extinguishment of the burner flame during a demand and heating supply mode, will be vented from the appliance before enabling the ignition circuit. The reliance on the inherent operating characteristics of a thermomechanical device for this function eliminates the necessity for provision of electronic time delays, safety switches and the like, which characterizes the prior art's approach to this problem. This control system, accordingly has fewer elements and is, therefore, less prone to failure than the prior art systems.

The invention has been described with reference to the illustrated and presently preferred embodiment. It is not intended that this description of the preferred embodiment be unduly limiting of the invention. Instead, it is intended that the invention be defined by the means, and their obvious equivalents, set forth in the following claims.

What is claimed is:

1. An ignition and control system for a burner assembly including a main fuel burner, a main fuel supply line connected to said main fuel burner, a pilot burner operative to ignite fuel discharged from said main burner, and a pilot fuel supply line connected to said pilot burner, said system comprising:

first and second normally closed valves for location in said pilot fuel and main fuel supply lines, respectively said first valve being a solenoid type valve having an actuator coil;

flame sensing means adjacent said pilot burner and including flame switch means responsive to heat to move between a cold position and a hot position upon exposure to said flame for a predetermined period of time;

heating demand means comprising a thermostat having a pair of electrical contacts;

ignition means operative to ignite fuel discharged from said pilot burner;

first control circuit means coupled to said pair of contacts of said thermostat and, through said flame switch means, to said cold position, and energizable in response to said heating demand means to operate said ignition means, said ignition means being rendered inoperable upon movement of said flame switch means from said cold position;

second control circuit means, including a relay having contact means in circuit with said actuator coil and responsive to energization of said first control circuit means to open said first valve; and third control circuit means coupled to said pair of contacts of said thermostat and, through said flame switch means, to said hot position, and energizable in response to said heating demand means to open said second valve.

2. The system of claim 1 wherein said flame sensing means comprises a diastat having a bulb filled with a liquid thermally expansible to move said switch means from said hot position to said cold position.

3. The system of claim 1 wherein said flame sensing means is adjustable whereby said predetermined period of time is from 5 to about 15 seconds.

* * * * *